US006073920A

United States Patent [19]

Colley

[11] Patent Number: 6,073,920

[45] Date of Patent: Jun. 13, 2000

[54] OBLIQUE CLAMP

[75] Inventor: Scott A. Colley, Fort Wayne, Ind.

[73] Assignee: Universal Consolidated Method, Inc., Topeka, Ind.

[21] Appl. No.: 09/179,368

[22] Filed: Oct. 26, 1998

[51] Int. Cl.[7] ..... B25B 1/20

[52] U.S. Cl. ..... 269/41; 269/249; 269/37; 269/45; 269/143

[58] Field of Search ..... 269/41, 271, 249, 269/143, 111, 124, 37, 45

[56] References Cited

U.S. PATENT DOCUMENTS

| | | | |
|---|---|---|---|
| 5,024,428 | 6/1991 | Ramsay | 269/274 |
| 5,462,264 | 10/1995 | Delagera | 269/249 |
| 5,733,061 | 3/1998 | Child | 269/249 |
| 5,950,294 | 9/1999 | Gibbs | 29/281.5 |

*Primary Examiner*—David A. Scherbel
*Assistant Examiner*—Lee Wilson
*Attorney, Agent, or Firm*—Taylor & Aust, P.C.

[57] ABSTRACT

A corner clamp joining a pair of generally orthogonal elongated members is formed by slicing a generally C-shaped frame form an aluminum alloy extrusion so that the frame includes a member spanning opening with a pressure pad defining one extremity of the opening and an opposite opening extremity face including a threaded hole and a threaded shaft passing through the threaded hole and helically movable therein toward and away from the pressure pad. The members are joined by clamping them together between the pressure pad and the end of the movable shaft. One elongated member may be an I-beam and the other a U-shaped channel with the U opening away from the I-beam. The slice is taken obliquely to the direction of elongation of the extrusion so that the pressure pad has a non-rectangular generally parallelogram shaped face. When assembled, one edge of the pressure pad face extends generally parallel and adjacent to an inner U surface.

11 Claims, 3 Drawing Sheets

OBLIQUE CLAMP

SUMMARY OF THE INVENTION

The present invention relates generally to C-clamps and more particularly to extruded oblique C-clamps for joining skewed or perpendicularly disposed elongated members. One application of the clamps of the present invention is joining the somewhat U-shaped ribs of metal roofing to supporting I-beams, for example, in the covered pump area of gasoline service stations.

It is commonplace to form C-clamps by slicing appropriately contoured aluminum extrusions. The slices are perpendicular to the axis of elongation of the extrusion. After slicing about all that is required to complete the clamp is to drill and tap a hole to receive a screw and, some times, a second pad or clamping face is attached to the screw. Some clamps require two extrusions.

The fixed one of the two clamping surfaces or pads of such an extruded clamp is normally rectangular in shape and normally adapts well to rectangular work piece clamping applications. However, when work pieces which are to be joined by such a clamp are skewed, for example, orthogonal to one another, the rectangular pad may not suit the application. This is particularly true where the fixed clamping pad must be skewed relative to and yet fit within an elongated trough. The prior art solution to such a problem is to reduce the size of the rectangular pad so that it will fit within the trough. It would be highly desirable when joining such obliquely disposed members, for the clamping pad to substantially span the width of the trough.

Among the several objects of the present invention may be noted the provision of an extruded type clamp adapted to clampingly joining a pair of obliquely disposed members; the provision of a unique extrusion style clamp manufacturing technique; and the provision of a clamp particularly suited to joining a U-shaped member orthogonally to another elongated member. These as well as other objects and advantageous features of the present invention will be in part apparent and in part pointed out hereinafter.

In general, a substantially enhanced area of contact between a clamp pad and a work piece is achieved for applications where obliquely disposed elongated members are joined with a clamp by forming the pad as a generally non-rectangular parallelogram. The parallelogram shape is achieved by slicing clamp frames from an extrusion along parallel planes which are oblique to the direction of extrusion elongation. This allows the clamp body to extend obliquely away from both members while the clamp pad has two sides parallel to the direction of elongation of one member when engaging a surface of that member.

BRIEF DESCRIPTION OF THE DRAWING

Corresponding reference characters indicate corresponding parts throughout the several views of the drawing.

Figure 1:
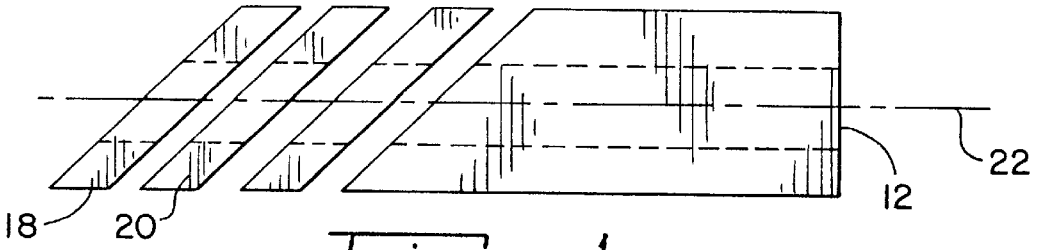
FIG. 1 is a side elevation view of an elongated aluminum alloy extrusion with several slices having been obliquely cut therefrom.
Figure 2:
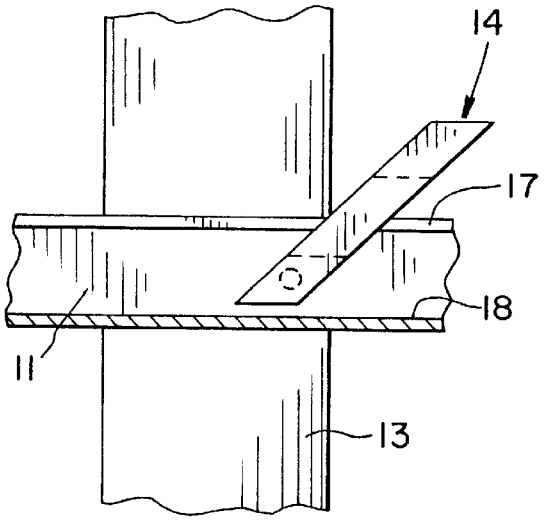
FIG. 2 is a top plan view of a left hand clamp joining a pair of orthogonally disposed members.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

To attach the somewhat U-shaped ribs 11 of metal roofing to the roof supporting I-beams 13 in the pump area of gasoline service stations, a clamp 14 is formed. The metal roofing (not shown) is attached to the upper edge of upstanding rib 18 which, in turn, is supported on approximately horizontal I-beams such as 13. The clamp is formed by slicing an aluminum alloy extrusion 12 at about 45 degrees to the longitudinal axis 22. Illustrative slices are shown as 18 and 20 in FIG. 1. Such oblique slices allow the foot or pad region 15 of the clamp to fit over the lip 17 of the roofing material while the clamp body extends obliquely away from the joint as shown in FIGS. 2, 3, 4 and 5.

Figure 1A:
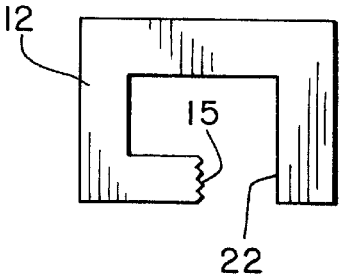
FIG. 1*a* is an end view of the extrusion of FIG. 1 from the right side thereof.
Figure 4:
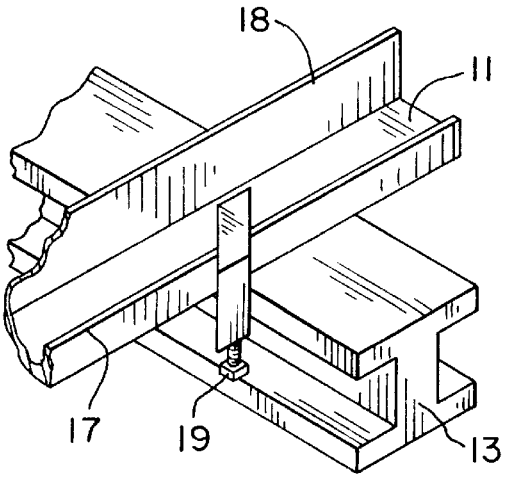
FIG. 4 is a perspective view of the clamp joined members of FIG. 2.
Figure 3:
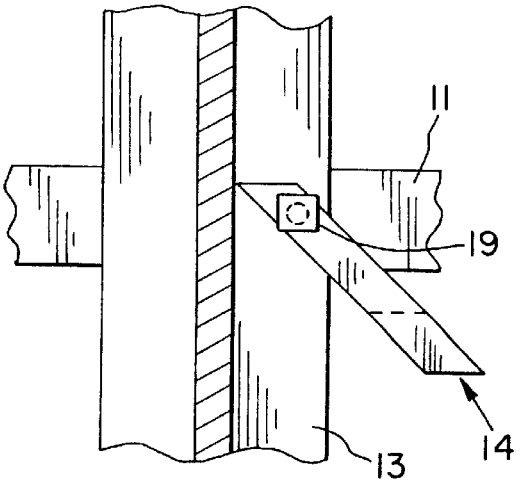
FIG. 3 is a bottom plan view in cross-section of the clamp joined members of FIG. 2.

The clamp 14 is formed by first extruding an elongated generally C-shaped channel 12 of FIG. 1 along channel axis 22 so that the channel having opposed C ends 15 and 22 as seen in the end view of FIG. 1*a*. The extrusion 12 is repeatedly sliced along parallel planes, each at about 45 degrees to the axis 22, thereby forming clamp frame members such as 18 and 20 from the channel along parallel planes each oblique to the channel axis.

After being sliced off, each clamp frame is drilled and tapped to form a threaded aperture 27 in each frame member near the C end 22. A threaded shaft such as the locking bolt 19 is then helically passed into each threaded aperture to complete the clamp and define a gap between one threaded shaft end and the other end 15 of the C with the length of the gap determined by the location of the threaded shaft 19 in the threaded aperture 27. Preferably a series of parallel ridges and grooves are formed as a part of the extrusion process along the C end 15 thereby forming the corrugated pressure pad.

Figure 6:
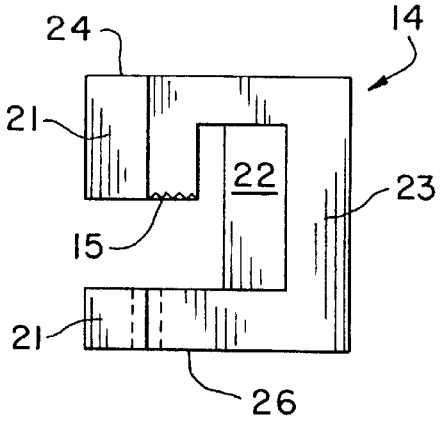
FIG. 6 is a front elevation view of the clamp of FIGS. 2, 3 and 4.
Figure 7:
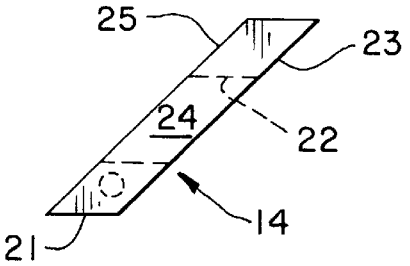
FIG. 7 is a top plan view of the clamp of FIG. 6.
Figure 8:
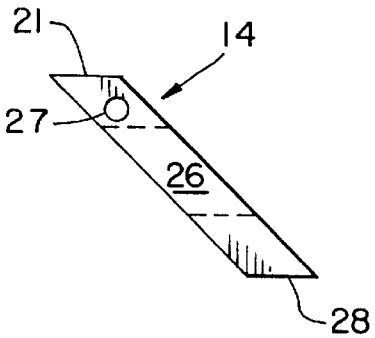
FIG. 8 is a bottom plan view of the clamp of FIG. 6.
Figure 9:
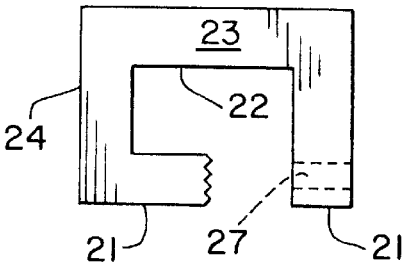
FIG. 9 is a side elevation view of the clamp of FIG. 6 taken from the right side of FIG. 7.
Figure 10:
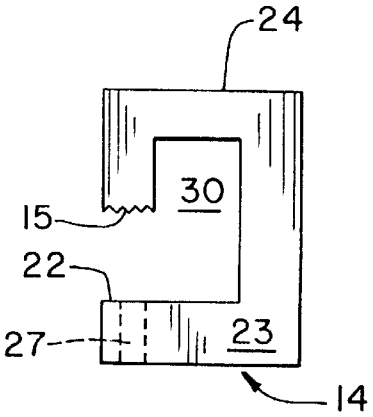
FIG. 10 is a side elevation view of the clamp of FIG. 6 taken from the right side of FIG. 6.
Figure 11:
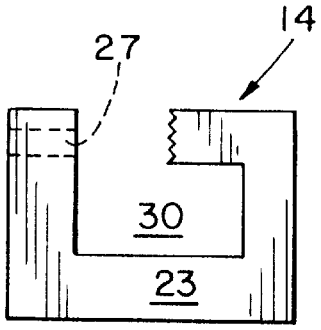
FIG. 11 is a side elevation view of the clamp of FIG. 6 taken from the right side of FIG. 8.

FIG. 6 is a front view of one clamp without the screw 19 while FIGS. 7 and 8 are top and bottom views respectively from FIG. 6. Note in FIG. 6, it is the surfaces 21 and 22 that are parallel to the plane of the paper while surfaces 23 and 25 slope obliquely at 45 degrees to the plane of the paper. FIGS. 9, 10 and 11 are views from the right side of FIGS.

Figure 12:
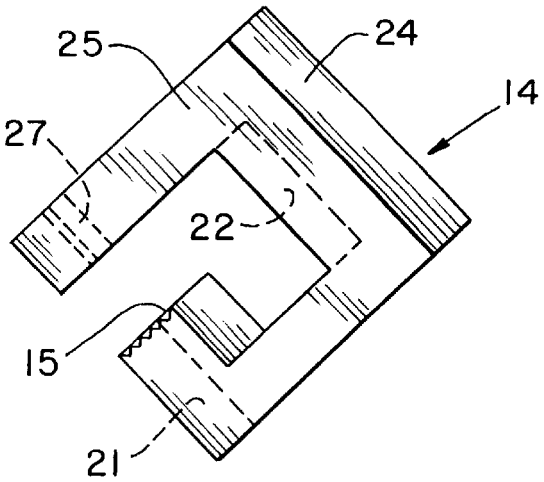
FIG. 12 is an oblique projection view taken at 45 degrees from the top view of FIG. 7.
Figure 13:
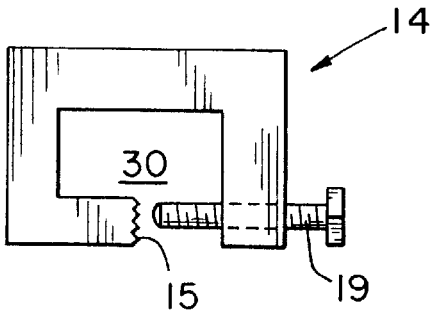
FIG. 13 is a side elevation view of the clamp of FIG. 6 similar to FIG. 9, but showing the tightening screw in place.

7, 6, and 8 respectively. Note again that surface 23, the surface created by the cutting of FIG. 1, slopes away from the plane of the paper at 45 degrees in FIGS. 9, 10 and 11. FIG. 12 is a view taken obliquely at 45 degrees from the top view of FIG. 7. Note in FIG. 12 it is the flat surface 25, again a surface created by a cut, which is parallel to the plane of the paper. Finally, FIG. 13 is a copy of FIG. 9, but showing the clamping screw 19 in position.

The clamp frame member of FIGS. 6–12 has first and second generally flat parallel left 25 and right 23 side surfaces; top 24 and bottom 26 generally flat parallel end surfaces lying in planes perpendicular to the side surfaces 23 and 25, and front 21 and rear 28 generally flat parallel side surfaces lying in planes perpendicular to the end surface planes 24 and 26, and oblique to the left 25 and right 23 side surfaces. The clamp frame member has an open interior region 30 which extends from the front side surface 21 toward the rear side surface 28 and from the left side surface 25 to the right side surface 23. The clamp frame member further includes the threaded aperture 27 which extends from the bottom end surface 26 near the front side surface 21 toward the top end surface 24, but, of course, terminating at the open interior region. Thus, the open interior region 30 is bordered by an inner rear surface 22 lying in a plane generally parallel to the rear side surface 28, an inner top surface lying in a plane generally parallel to the top end surface 24 plane and an inner bottom surface lying in a plane generally parallel to the plane of the bottom end surface 26. The open interior region 30 is further bordered by the corrugated surface of the pad 15 which extends from the front side surface 21 and lies in an approximate plane generally parallel to the top end surface 24.

Figure 14:
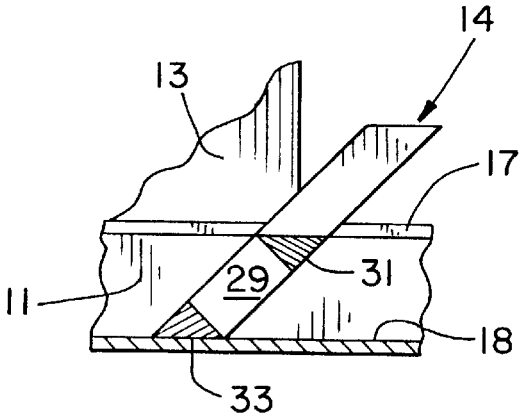
FIG. 14 is a view similar to a portion of FIG. 2, but illustrating one advantageous feature of the invention.

The advantages of the present invention should now be clear. In FIG. 14, the area of contact of a conventional rectangular pad is shown by rectangle 29. If the pad is made trapezoidal by cutting along 45 degree planes, the contact area is increased by the area of the triangular regions 31 and 33, about ⅓ more for the illustrated clamp width. Moreover, the contact area is moved toward the center of the I-beam 13 by the addition of triangle 33. Of course, larger rectangular contact areas are easily created by simply widening the clamp, however, the wider clamp surface 22 will contact the edges of members 11 and 13 further away from the overlap region of the members, thus requiring a much larger and heavier clamp. Thus, the contact area of the clamp pad engaging the U-shaped member is optimized by the present invention for given constraints.

Figure 5:
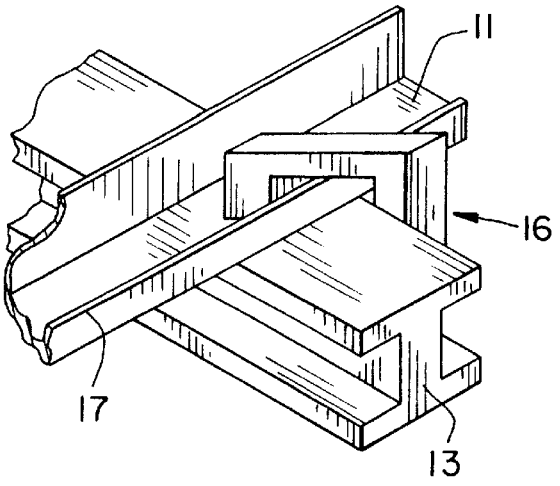
FIG. 5 is a perspective view similar to FIG. 4, but showing the members joined by a right hand clamp.

From the foregoing, it is now apparent that a novel clamping arrangement for joining generally orthogonally disposed elongated beams or similar members as well as a novel technique for fabricating such clamps has been disclosed meeting the objects and advantageous features set out hereinbefore as well as others. Numerous modifications will now be apparent. The clamp may be made by slicing the FIG. 1 extrusion along planes perpendicular to the illustrated planes thereby creating the right hand clamp such as 16 which fits the opposite side of the I-beam as shown in FIG. 5. While shown as substantially sharp right-angled corners, the clamp corners and edges may be rounded or formed as desired. These as well as numerous other modifications as to the precise shapes, configurations and details may be made by those having ordinary skill in the art without departing from the spirit of the invention or the scope thereof as set out by the claims which follow.

What is claimed is:

1. A clamp frame member having first and second generally flat parallel left and right side surfaces; top and bottom generally flat parallel end surfaces lying in planes perpendicular to the side surfaces; and front and rear generally flat parallel side surfaces lying in planes perpendicular to said end surface planes and oblique to said left and right side surfaces.

2. The clamp frame member of claim 1 including an open interior region extending from the front side surface toward the rear side surface and from the left side surface to the right side surface.

3. The clamp frame member of claim 2 further including a threaded aperture extending from the bottom end surface near the front side surface toward the top end surface and terminating at the open interior region.

4. The clamp frame member of claim 2 wherein the open interior region is bordered by an inner rear surface lying in a plane generally parallel to the rear side surface, an inner top surface lying in a plane generally parallel to the top end surface plane and an inner bottom surface lying in a plane generally parallel to the plane of the bottom end surface.

5. The clamp frame member of claim 4 wherein the open interior region is further bordered by a corrugated surface extending from the front side surface and generally parallel to the top end surface.

6. The clamp frame member of claim 5 further including a threaded aperture extending from the bottom end surface near the front side surface toward the top end surface and terminating at the open interior region facing the corrugated surface.

7. A corner clamp joining a pair of generally orthogonal elongated members comprising a generally C-shaped frame having a member spanning opening with a pressure pad defining one extremity of the opening and an opposite opening extremity face including a threaded hole and a threaded shaft passing through the threaded hole and helically movable therein toward and away from the pressure pad, the pressure pad comprising a grooved non-rectangular generally parallelogram shaped face.

8. The combination of claim 7 wherein one elongated member is an I-beam and the other is a U-shaped channel with the U opening away from the I-beam, one edge of the pressure pad face extending generally parallel and adjacent to an inner U surface.

9. The method of making a plurality of corner clamps comprising:

extruding an elongated generally C-shaped channel along a channel axis, the channel having opposed C ends;

repeatedly slicing clamp frame members from the channel along parallel planes each oblique to the channel axis;

forming a threaded aperture in each frame member near one C end;

helically passing threaded shafts into respective threaded apertures to define a gap between one threaded shaft end and the other end of the C the length of which is determined by the location of the threaded shaft in the threaded aperture.

10. The method of claim 9 wherein the angle between the planes of the slices and the channel axis is about 45 degrees.

11. The method of claim 9 wherein the step of extruding includes forming parallel ridges and grooves along said one C end.

* * * * *